US009388661B2

(12) United States Patent
Jasek

(10) Patent No.: US 9,388,661 B2
(45) Date of Patent: Jul. 12, 2016

(54) METHODS AND SYSTEMS FOR TREATING A WELLBORE

(71) Applicant: Schlumberger Technology Corporation, Sugar Land, TX (US)

(72) Inventor: Sidney Jasek, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 418 days.

(21) Appl. No.: 13/724,535

(22) Filed: Dec. 21, 2012

(65) Prior Publication Data

US 2014/0034336 A1 Feb. 6, 2014

Related U.S. Application Data

(60) Provisional application No. 61/677,989, filed on Jul. 31, 2012.

(51) Int. Cl.
*E21B 43/04* (2006.01)
*E21B 33/13* (2006.01)

(52) U.S. Cl.
CPC ..... *E21B 33/13* (2013.01); *E21B 43/04* (2013.01)

(58) Field of Classification Search
CPC ..... E21B 34/14; E21B 43/04; E21B 43/045; E21B 2034/007
See application file for complete search history.

(56) References Cited

U.S. PATENT DOCUMENTS 3,410,348 A * 11/1968 Page ..... 166/120
4,951,750 A * 8/1990 Wetzel, Jr. ..... 166/278
5,332,038 A * 7/1994 Tapp et al. ..... 166/278
7,870,909 B2 1/2011 John et al.
8,201,631 B2 6/2012 Stromquist et al.
2002/0195253 A1 * 12/2002 Hill, Jr. ..... E21B 21/10 166/380
2009/0159299 A1 6/2009 Kratochvil et al.
2010/0139917 A1 6/2010 Weirich
2010/0243270 A1 9/2010 Ingram et al.
2011/0100643 A1 * 5/2011 Themig et al. ..... 166/373
2012/0013482 A1 1/2012 Patel et al.
2013/0062066 A1 * 3/2013 Broussard et al. ..... 166/305.1

OTHER PUBLICATIONS

EP 13825033.7 European Supplementary Search Report, dated Feb. 19, 2016, 3 pgs.
EP 13825033.7 European Examination Report, dated Mar. 9, 2016, 5 pgs.

* cited by examiner

*Primary Examiner* — Blake Michener
*Assistant Examiner* — Kipp Wallace
(74) *Attorney, Agent, or Firm* — Jeffrey R. Peterson

(57) ABSTRACT

A completion assembly for treating a wellbore. The completion assembly can include a tubular member having a bore formed axially therethrough and a port formed radially therethrough. An annulus can be disposed radially outward from the tubular member and the port can provide fluid communication between the annulus and the bore. A packer can be coupled to the tubular member and adapted to isolate first and second portions of the annulus. A seal bore can be coupled to the tubular member such that the port is disposed axially between the packer and the seal bore. A straddle seal can be adapted to contact the packer and the seal bore to prevent fluid flow between the annulus and the bore. The straddle seal can be run into the wellbore with the completion assembly in a single trip.

20 Claims, 5 Drawing Sheets

METHODS AND SYSTEMS FOR TREATING A WELLBORE

RELATED APPLICATIONS

This application claims the benefit of a related U.S. Provisional Application Ser. No. 61/677,989 filed Jul. 31, 2012, entitled "System and Method of Treating a Well" to Jasek, the disclosure of which is incorporated by reference herein in its entirety.

BACKGROUND

Embodiments described herein generally relate to methods and systems for treating a wellbore. More particularly, embodiments described herein relate to providing a fluid pressure barrier across a treatment port in a wellbore.

Hydrocarbon recovery operations (e.g., gravel packing operations) often require a sufficient fluid pressure barrier across the treatment ports during one or more processes. Typically, a sleeve is actuated or shifted to cover the treatment ports to provide such a barrier. Due to the debris present in the wellbore environment, the actuating or shifting of the sleeve to seal the treatment ports results in the erosion of the sleeve and/or the tubular member adjacent the sleeve. The erosion of the sleeve and the tubular member diminishes the ability of the sleeve to provide a sufficient pressure barrier. Accordingly, a separate seal (e.g., straddle seal) that is not compromised by the debris is often provided as a second barrier for the treatment ports. The implementation of the separate seal, however, requires multiple trips in and out of the wellbore and the use of many additional complex tools. This results in added cost and time for these operations, which are further augmented in treating a multi-zone wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A completion assembly for treating a wellbore is disclosed. The completion assembly can include a tubular member having a bore formed axially therethrough and a port formed radially therethrough. An annulus can be disposed radially outward from the tubular member and the port can provide fluid communication between the annulus and the bore. A packer can be coupled to the tubular member and adapted to isolate first and second portions of the annulus. A seal bore can be coupled to the tubular member such that the port is disposed axially between the packer and the seal bore. A straddle seal can be adapted to contact the packer and the seal bore to prevent fluid flow between the annulus and the bore. The straddle seal can be run into the wellbore with the completion assembly in a single trip.

A method for treating a wellbore is disclosed. The method can include locating a completion assembly within a wellbore. The completion assembly can include a tubular member having a bore formed axially therethrough and a port formed radially therethrough. An annulus can be disposed radially outward from the tubular member and the port can provide fluid communication between the annulus and the bore. A packer can be coupled to the tubular member and adapted to isolate first and second portions of the annulus. A seal bore can be coupled to the tubular member such that the port is disposed axially between the packer and the seal bore. A straddle seal can be run into the wellbore with the completion assembly in a single trip. The method can further include actuating the straddle seal from a first position to a second position with a service tool, or inner string. In the first position, the straddle seal can be positioned below the packer, the seal bore, or both. In the second position, the straddle seal can contact the packer and the seal bore to prevent fluid flow between the annulus and the bore.

Another method for treating a wellbore is also disclosed. The method can include locating a completion assembly within a wellbore. The completion assembly can include a tubular member having a bore formed axially therethrough and a port formed radially therethrough. An annulus can be disposed radially outward from the tubular member and the port can provide fluid communication between the annulus and the bore. A packer can be coupled to the tubular member and adapted to isolate first and second portions of the annulus. A seal bore can be coupled to the tubular member such that the port is disposed axially between the packer and the seal bore. The completion assembly can further include a screen assembly coupled to the tubular member. The screen assembly can be disposed below the treatment port of the tubular member and can be adapted to control a flow of a fluid from the annulus into the bore.

BRIEF DESCRIPTION OF THE DRAWINGS

Embodiments of "Systems and Methods of Treating a Wellbore" are described with reference to the following figures. The same numbers are used throughout the figures to reference like features and components.

DETAILED DESCRIPTION

Figure 1:
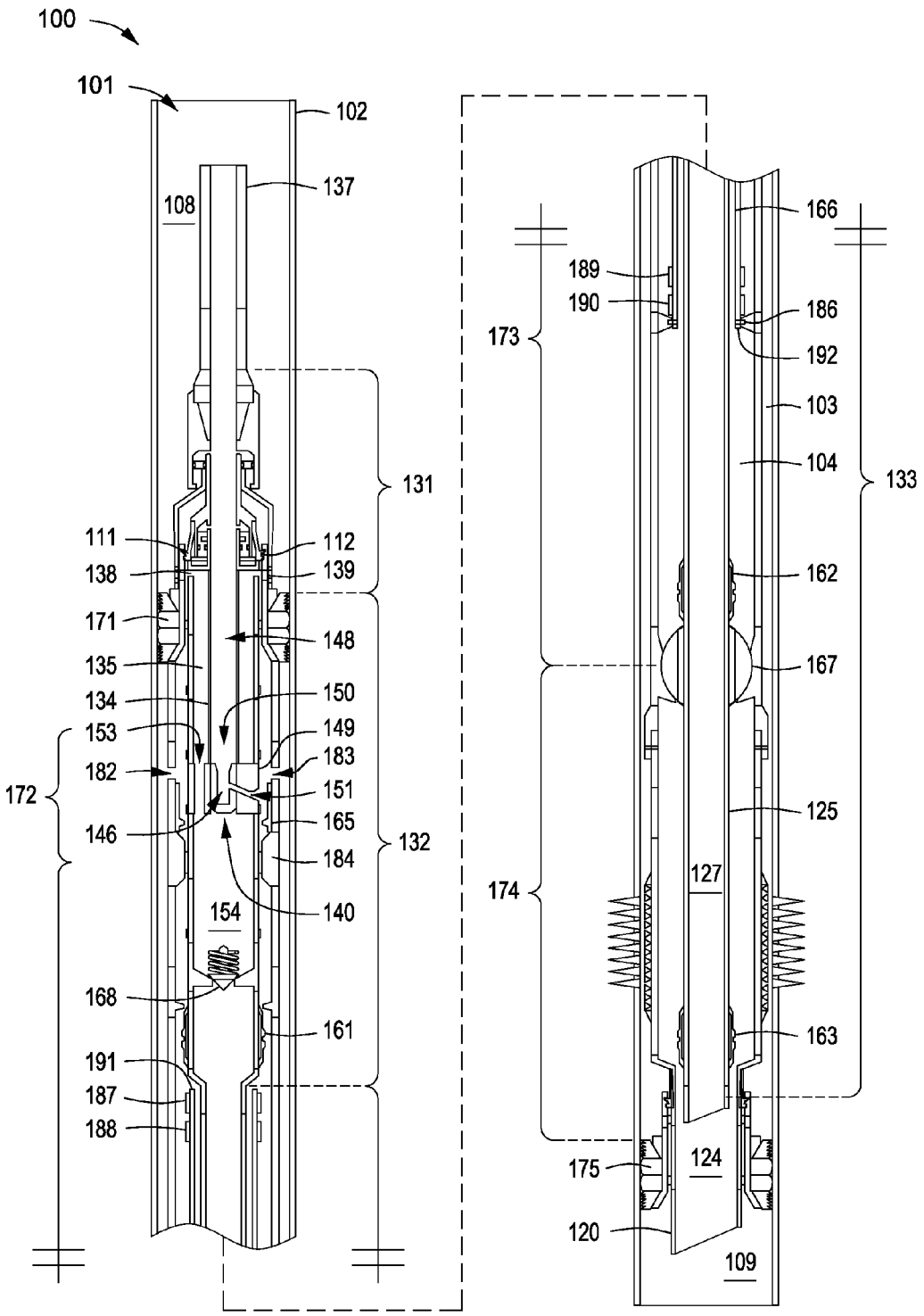
FIG. 1 depicts a cross-sectional view of an illustrative completion assembly for treating a wellbore, according to one or more embodiments disclosed.

FIG. 1 depicts a cross-sectional view of an illustrative completion assembly 100 for treating a wellbore 101, according to one or more embodiments. A casing 102 can be disposed within the wellbore 101. One or more tubular members (one is shown 120) can be disposed within the casing 102 forming a first annulus 103 between the tubular member 120 and the casing 102. An inner string or service tool 125 can be or include a tubular member and can be disposed at least partially within the tubular member 120 forming a second annulus 104 therebetween. The service tool 125 can be used to run the tubular member 120 into the wellbore 101. The service tool 125 can also be used to set the tubular member 120 within the wellbore 101.

The service tool 125 can be two or more segments or sections connected together. For example, the service tool 125 can include a single section, two or more sections, three or more sections, four or more sections, ten or more sections, or any number of sections to properly locate the completion assembly 100 at a desired depth or location within the wellbore 101. A first section of the service tool 125 can be a setting and/or running tool 131, a second section can be a gravel pack tool 132, and a third section can be a wash pipe 133. One or more additional sections can be disposed between one or more sections of the service tool 125. For example, blank pipe (not shown) can be disposed between or adjacent to any of the sections 131, 132, 133.

The setting tool 131 of the service tool 125 can be connected to a drill string or drill pipe 137. The drill pipe 137 can convey the setting tool 131 into the wellbore 101. As the drill pipe 137 conveys the setting tool 131 into the wellbore 101, the setting tool 131 can run the tubular member 120 into the wellbore 101. The drill pipe 137 can also remove the service tool 125 from the wellbore 101 and/or provide fluid communication between the surface and a bore 127 of the service tool 125.

The setting tool 131 and/or the service tool 125 can be releasably coupled to the tubular member 120 and/or a first packer 171 of the tubular member 120. For example, the setting tool 131 and/or the service tool 125 can have one or more collets (two are shown 111, 112) that can be actuated to release the setting tool 131 and/or the service tool 125 from the tubular member 120. The collets 111, 112 can be threadably connected to the tubular member 120. When the setting tool 131 and/or the service tool 125 is engaged or coupled with the tubular member 120, the setting tool 131 and/or the service tool 125 can be rotated to release the collets 111, 112 from the tubular member 120. Accordingly, when the collets 111, 112 are released from the tubular member 120, setting tool 131 and/or the service tool 125 can be free to move from the tubular member 120. Releasing the setting tool 131 and/or the service tool 125 from the tubular member 120 can allow the setting tool 131 and/or the service tool 125 to be retrieved and/or repositioned in the wellbore 101. In another embodiment, the setting tool 131 and/or the service tool 125 can be configured to be released from the second tubular 120 through hydraulic pressure by building pressure within the setting tool 131 and/or the service tool 125. For example, the drill pipe 137 can provide a pressurized fluid to release the setting tool 131 and/or the service tool 125 from the tubular member 120. DGM: Please review and update based on Sidney's comment.

One or more ports (two are shown 138, 139) can be disposed about the service tool 125 adjacent the setting tool 131 and/or the gravel pack tool 132. The ports 138, 139 can be formed through the service tool 125 in any radial and/or longitudinal pattern. In one or more embodiments (shown in FIG. 2), the ports 138, 139 can be located about the service tool 125 such that the bore 127 of the service tool 125 can be in fluid communication with an first or "upper" portion 108 of the wellbore 101.

The service tool 125 can include one or more inner tubular members (one is shown 134). In at least one embodiment, the inner tubular member 134 can be disposed within the gravel pack tool 132 of the service tool 125 forming an inner annulus 135 therebetween. The inner tubular member 134 can include a ball-actuated flow control valve 140. The flow control valve 140 can be coupled to the inner tubular member 134, for example, in a slot, aperture, or other opening defined in the inner tubular member 134. The flow control valve 140 can span the opening 142 of the inner tubular member 134. The flow control valve 140 can define one or more orifices (one is shown 146) extending therethrough. In a first position, the orifice 146 can provide fluid communication between a bore 148 of the inner tubular member 134 and the second annulus 104 via a cross-over 149 disposed proximate the flow control valve 140. The second annulus 104 can be defined by the first packer 171 and the seal bore 184. Providing fluid communication between the bore 148 and the second annulus 104 in the first position can allow a pressure in completion assembly 100 to equalize during one or more processes (e.g., conveying the completion assembly 100 into the wellbore 101). In a second position, the control valve 140 can prevent fluid communication through the orifice 146. The flow control valve 140 can also include a ball seat 150 extending radially-inward therefrom.

Figure 2:
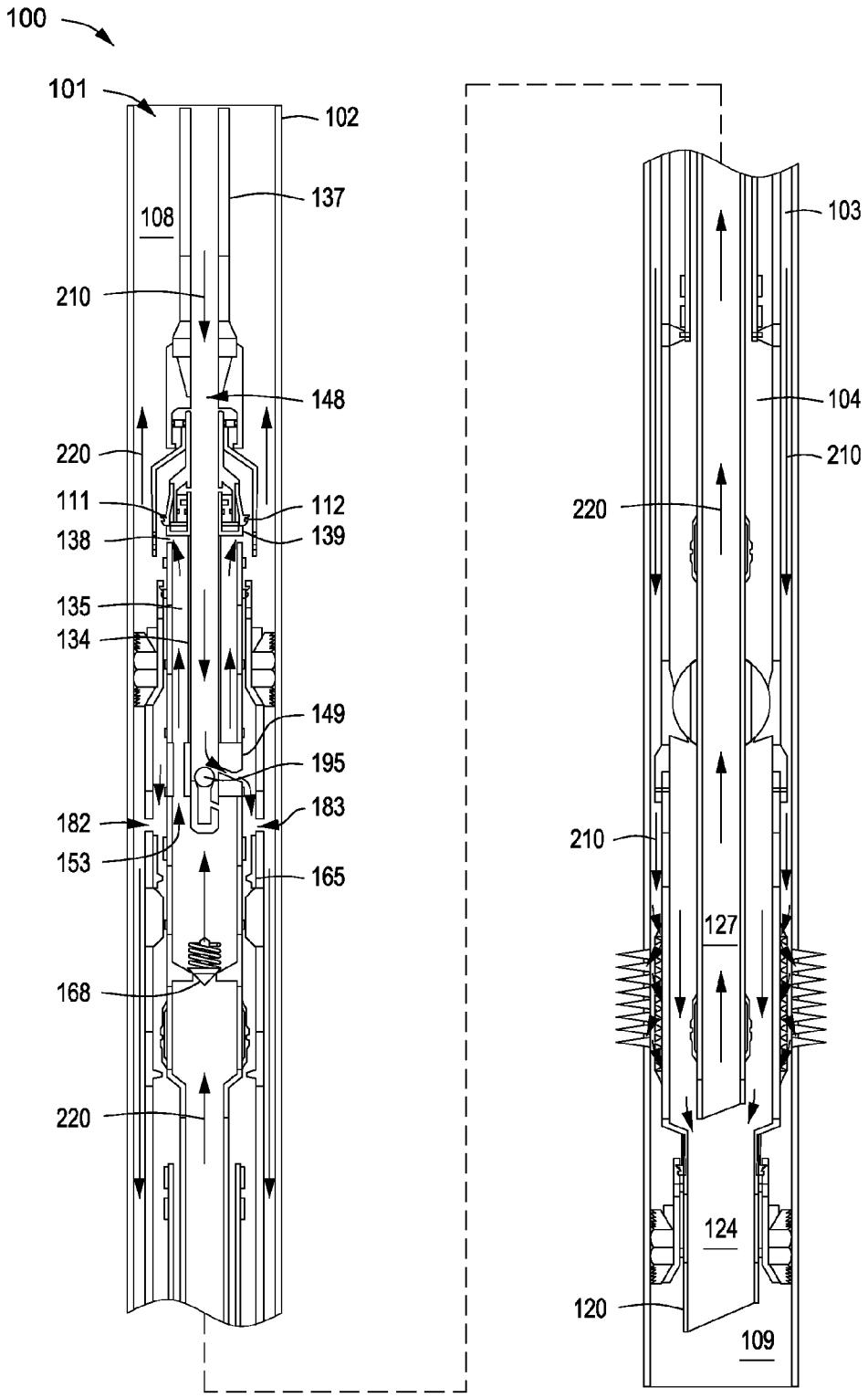
FIG. 2 depicts a cross-sectional view of the completion assembly with the tubular member and the service tool positioned to perform a gravel pack operation, according to one or more embodiments disclosed.

When it is desired to open the flow control valve 140 and, thus, provide fluid communication between the inner tubular member 134 and the second annulus 104, a ball or trigger 195 can be deployed into the inner tubular member 134, as shown in FIG. 2. The ball 195 can be deployed, for example, via the service tool 125. The ball 195 can engage the ball seat 150 and can form a fluid tight seal therewith, thus obstructing fluid flow through the orifice 146. The fluid tight seal provided by the ball 195 can also allow the building of pressure within the completion assembly 100 to set one or more packers 171, 175, as discussed below. As such, the flow control valve 140 can be opened/closed by the ball 195, thereby providing fluid communication between the inner tubular member 134 and the second annulus 104.

The cross-over 149 can be integrally-formed with or otherwise coupled with the service tool 125 and the inner tubular member 134 such that a seal is formed therebetween. The cross-over 149 can include a cross-over port 151 formed therethrough. The cross-over port 151 can be located about the cross-over 149 such that the bore 148 of the inner tubular member 134 can be in fluid communication with the second annulus 104 via the orifice 146 of the flow control valve 140 and the cross-over port 151. The cross-over 149 can also include a through-port 153 formed therethrough. The through-port 153 can be located about the cross-over 149 such that the inner annulus 135 can be in fluid communication with the wash pipe 135 of the service tool 125 via a one-way valve 168.

The wash pipe 135 section of the service tool 125 can be connected to the gravel pack tool 132, and can provide fluid communication from a bore 154 of the gravel pack tool 132 to a second or "lower" portion 109 of the wellbore 101.

Figure 3:
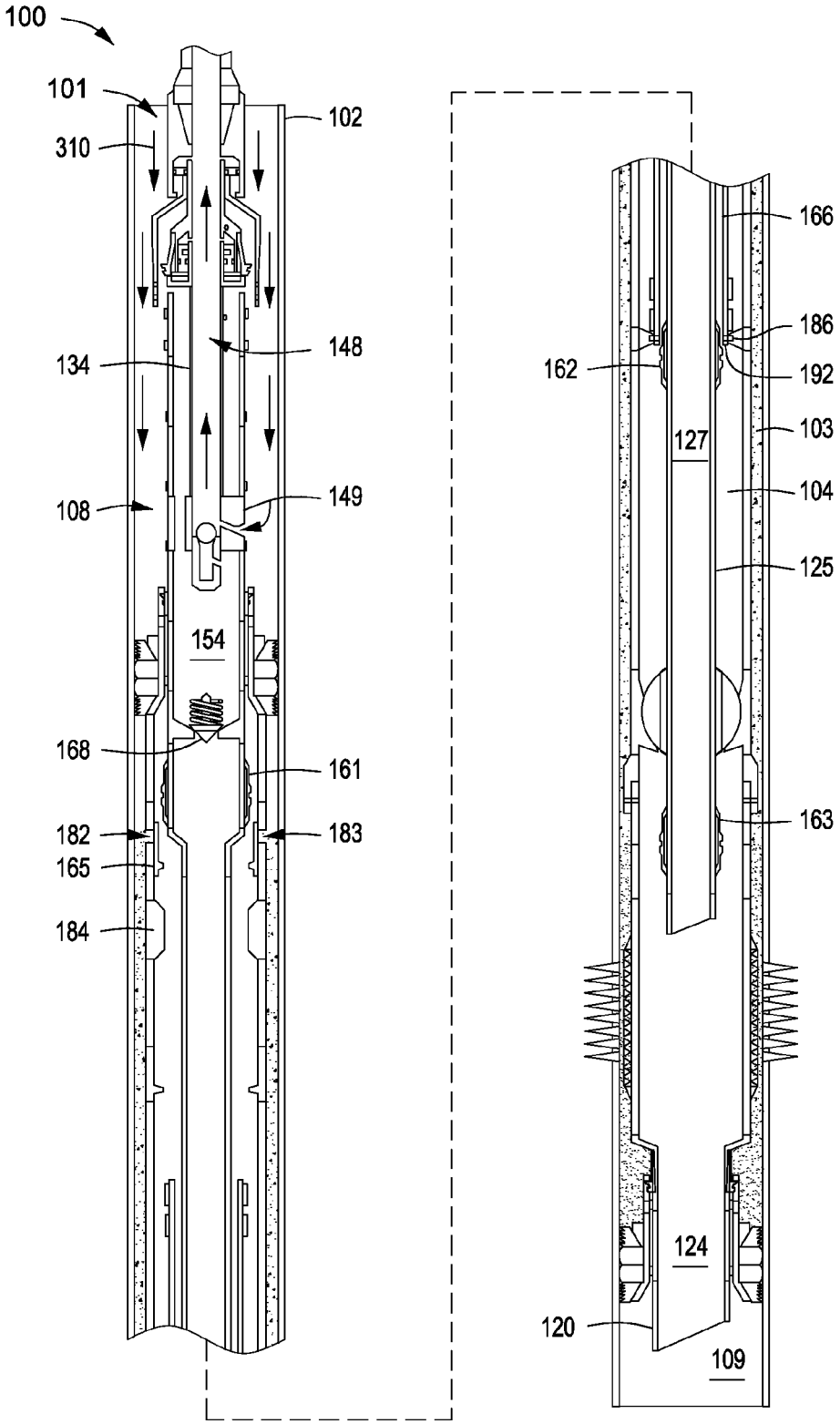
FIG. 3 depicts a cross-sectional view of the completion assembly with the service tool positioned to perform a reverse flow operation, according to one or more embodiments disclosed.
Figure 5:
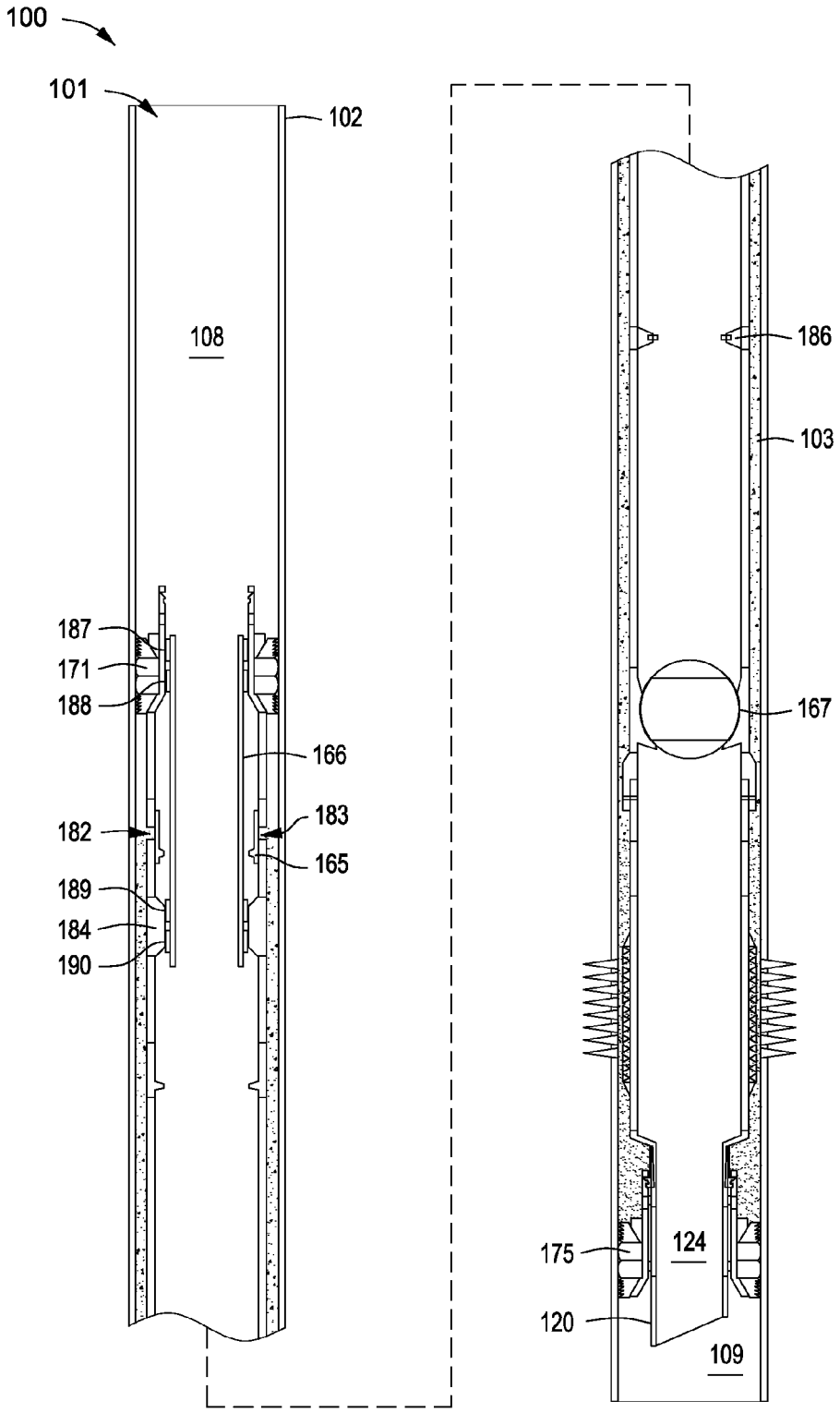
FIG. 5 depicts a cross-sectional view of the completion assembly with the service tool removed from the wellbore, according to one or more embodiments disclosed.

The service tool 125 can have one or more collets or latching members (three are shown 161, 162, 163) that can releasably engage one or more portions of the tubular member 120. For example, the service tool 125 can have one or more sleeve collets 161, one or more straddle seal collets 162, one or more fluid loss control device ("FLCD") collets 163, or any combination thereof. The sleeve collet 161 can be disposed about an outer surface of the service tool 125 in one or more sections 131, 132, 133 thereof. For example, as shown in FIG. 1, the sleeve collet 161 can be disposed about the outer surface of the service tool 125 proximate the gravel pack tool 132. The sleeve collet 161 can correspond with a closing profile (not shown) in a sliding sleeve 165. As such, the sleeve collet 161 can engage the closing profile, and an upward movement of the setting tool 131 can move the sleeve 165 into the closed position (FIG. 3). The straddle seal collet 162 can be disposed about the outer surface of one or more sections 131, 132, 133 of the service tool 125. For example, as shown in FIG. 1, the straddle seal collet 162 can be disposed about the outer surface of the service tool 125 proximate the wash pipe 135. The straddle seal collet 162 can correspond with a profile (not shown) in a straddle seal 166. As such, the straddle seal collet 162 can engage the profile (not shown), and an upward movement of the setting tool 131 can move the straddle seal collet 162 into a closed position (FIG. 5). The FLCD collet 163 can be disposed about the outer surface of the service tool 125 in one or more sections 131, 132, 133. For example, as shown in FIG. 1, the FLCD collet 163 can be disposed about the outer surface of the service tool 125 proximate the wash pipe 135. The FLCD collet 163 can correspond with a profile (not shown) in an FLCD 167, as discussed in further detail below. As such, the FLCD collet 163 can engage the profile, and an upward movement of the setting tool 131 can actuate the FLCD 167 to a closed position.

Although the service tool 125 is depicted with collets 161, 162, 163 adapted to actuate (e.g., open and close) the sleeve 165, the straddle seal 166, and/or the FLCD 167, it can be appreciated that the service tool 125 can include any device known in the art capable of actuating the sleeve 165, the straddle seal 166, and/or the FLCD 167. Illustrative devices capable of actuating the sleeve 165, the straddle seal 166, and/or the FLCD 167 can include, but are not limited to, spring-loaded keys, drag blocks, snap-ring constrained profiles, and the like.

The service tool 125 can include one or more one-way valves (one is shown 168) disposed between the bore 154 of the gravel pack tool 132 and a bore 129 of the wash pipe 135. The one-way valve 168 can include a flapper valve that can be actuated between an open position allowing bi-directional fluid communication through the service tool 125, and a closed position allowing uni-directional, i.e., upward, fluid communication through the service tool 125. Illustrative one-way valves can include, but are not limited to, ball and seat valves, check valves, or other valves capable of allowing fluid flow in a first direction and blocking fluid flow in a second direction.

The tubular member 120 can be two or more segments or sections connected together. For example, the tubular member 120 can include a single section, two or more sections, three or more sections, four or more sections, ten or more sections, or any number of sections to properly locate the completion assembly 100 at a desired depth or location with the wellbore 101. A first section of the tubular member 120 can be or include the first or "upper" packer 171, a second section can be or include a housing 172, a third section can be or include a casing extension 173, a fourth section can be or include a screen assembly 174, a fifth section can be or include a second or "lower" packer 175. The casing extension 173 can be or include one or more blank pipes. One or more additional sections or blank pipes (not shown) can be disposed between one or more sections 171, 172, 173, 174, 175 of the tubular member 120. For example, blank pipe (not shown) can be disposed between or adjacent to any of the sections 171, 172, 173, 174, 175 of the tubular member 120.

The first packer 171 can be used to isolate the first portion 108 of the wellbore 101 from the first annulus 103. The first packer 171 can also secure the tubular member 120 within the wellbore 101. The second packer 175 can be used to isolate the second portion 109 of the wellbore 101 from the first annulus 103. The second packer 175 can also secure the tubular member 120 within the wellbore 101. The first and second packers 171, 175 can be any downhole sealing device. Illustrative packers 171, 175 can include, but are not limited to, compression or cup packers, inflatable packers, "control line bypass" packers, polished bore retrievable packers, swellable packers, sump packers, or any combination thereof.

The housing 172 can include one or more treatment ports (two are shown 182, 183) formed through at least a portion thereof. The treatment ports 182, 183 can be formed through the housing 172 of the tubular member 120 in any radial and/or longitudinal pattern. In one or more embodiments, the treatment ports 182, 183 can be located about the tubular member 120 such that the first annulus 103 can be in fluid communication with the second annulus 104 defined by the first packer 171 and a seal bore 184. The seal bore 184 can be disposed on the inner surface of the tubular member 120 between the housing 172 and the casing extension 173. The seal bore 184 can extend radially inward and span the second annulus 104 to provide a seal. The seal bore 184 can be or include any device known in the art capable of preventing fluid communication therethrough. Illustrative seal bores 184 can include, but are not limited to, a polished bore receptacle, an expandable metal-to-metal seal, an elastomeric seal, or any combination thereof.

The housing 172 can include the sliding sleeve 165 that is capable of covering and sealing the treatment ports 182, 183, thereby preventing fluid communication through the treatment ports 182, 183. In at least one embodiment, the sleeve 165 can be any valve element or device capable of sealing the treatment ports 182, 183. The sleeve 165 can be disposed about the inner surface of the tubular member 120 in the housing 172. In another embodiment, the sleeve 165 can be disposed in a recess (not shown) to avoid obstructing the second annulus 104. The sleeve 165 can include a closing profile (not shown) that can correspond with the sleeve collet 161 disposed about the outer surface of the service tool 125. As previously discussed, the sleeve collet 161 can engaged the closing profile, and an upward movement of the setting tool 131 can move the sleeve 165 into the closed position, as shown in FIG. 3. In the closed position the sleeve 165 can provide a barrier to debris contained in the wellbore 101.

The casing extension 173 can include the straddle seal 166 for selectively isolating the treatment ports 182, 183 in the housing 172. The straddle seal 166 can be or include a tubular member 120 disposed concentrically in the second annulus 104. The straddle seal 166 can be disposed anywhere along the tubular member 120. For example, the straddle seal 166 can be disposed about the tubular member 120 such that it is axially offset from the treatment ports 182, 183. As shown in FIG. 1, the straddle seal 166 can be in a first or "open" position in the casing extension 173. In at least one embodiment, the first position, as shown in FIG. 1, can be a position below the treatment ports 182, 183, the first packer 171, the seal bore, or any combination thereof. As used herein, the term "below" refers to a position in the wellbore 101 that is farther away from the surface than another position.

The straddle seal 166 can be held in the first position by any device capable of detachably coupling the straddle seal 166 to the tubular member 120. For example, the straddle seal 166 can be held in the first position by a latch or lock mechanism 186. The straddle seal 166 can include one or more seal members (four are shown 187, 188, 189, 190). The seal members 187, 188, 189, 190 can be secured or coupled to the straddle seal 166 proximate a first or "upper" end 191 and a second or "lower" end 192 of the straddle seal 166. The seal members 187, 188, 189, 190 can be or include one or more elastomer, rubber, blends thereof, or any other compliable materials capable of providing a fluid tight seal.

The straddle seal 166 can include a closing profile (not shown) that can correspond with the straddle seal collet 162 disposed about the outer surface of the service tool 125. As previously discussed, the straddle seal collet 162 can engage the closing profile of the straddle seal 166, and an upward movement of the service tool 125 can move the straddle seal 166 into a second or "closed" position, as shown in FIG. 5. In at least one embodiment, the straddle seal collet 162 can engage the closing profile of the straddle seal 166 to disengage the latch or lock mechanism 186 coupling the straddle seal 166 to the tubular member 120.

In the closed position, the seal members 187, 188, 189, 190 of the straddle seal 166 can engage or provide a seal between the straddle seal 166 and the inner surface of the tubular member 120. For example, as shown in FIG. 5, the seal members 187, 188 coupled to the first end 191 of the straddle seal 166 can engage the inner surface of the tubular member 120 proximate the first packer 171, and the seal members 189, 190 coupled to the second end 192 of the straddle seal 166 can engage the seal bore 184. In at least one embodiment, the seal members 187, 188 coupled to the first end 191 of the straddle seal 166 can engage a second seal bore (not shown) proximate the first packer 171. In the closed position the straddle seal 166 can provide a fluid pressure barrier to prevent fluid communication from the first annulus 104 to a bore 124 of the tubular member 120.

In at least one embodiment, the sleeve 165 can provide a first fluid barrier and the straddle seal 166 can provide a second fluid barrier to isolate the first annulus 103. For example, if the sleeve 165 and the straddle seal 166 are in the respective closed positions, fluid communication can be restricted by the sleeve 165 and the straddle seal 166. In at least one embodiment, the straddle seal 166 can have a higher fluid seal rating as compared to the sleeve 165. For example, in the closed position, the straddle seal 166 can provide a fluid pressure barrier with a fluid seal rating from a low of about 4,000 psi, about 5,000 psi, about 6,000 psi, or about 7,000 psi, to a high of about 12,000 psi, about 13,000 psi, about 14,000 psi, about 15,000 psi, about 16,000 psi, about 17,000 psi, or more. In at least one embodiment, the straddle seal 166 can provide a sufficient fluid barrier for one or more downhole operations of the completion assembly 100. Accordingly, the completion assembly 100 can provide a fluid pressure barrier to isolate the second annulus 104 without the sleeve 165.

The screen assembly 174 can be or include one or more sand screen completions, inflow control device completions, or other completions for performing downhole operations. In addition, the screen assembly 174 can be used to control the flow of one or more fluids flowing from the first annulus 103 into the tubular member 120. In another embodiment, the screen assembly 174 can be used to control the flow of one or more fluids flowing from the tubular member 120 to the wellbore 101 and/or hydrocarbon bearing zone. The fluid can be or include any fluid delivered to a formation to stimulate production including, but not limited to, fracing fluid, gravel slurry, acid, gel, foam or other stimulating fluid. The fluid can be injected into the wellbore 101 to provide an acid treatment, a clean up treatment, and/or a work over treatment to the wellbore 101 and/or hydrocarbon producing zone. In at least one embodiment, the fluid is a gravel slurry for a gravel packing operation. The gravel slurry can include particulate (e.g., gravel) and a carrier fluid or gravel pack fluid.

The tubular member 120 can include one or more FLCDs (one is shown 167) coupled to or disposed within the inner surface of the tubular member 120 and/or about the outer surface of the service tool 125. In at least one embodiment, the FLCD 167 is disposed between the casing extension 173 and the screen assembly 174. In a first position (shown in FIG. 1), the FLCD 167 can be used to selectively prevent fluid communication through the second annulus 104. In a second position (shown in FIGS. 4 and 5), the FLCD 167 can prevent fluid communication through the bore 124 of the tubular member 120. The FLCD 167 can include a profile (not shown) that can engage a FLCD collet 163 coupled to the outer surface of the service tool 125. When the service tool 125 is removed, the FLCD collet 163 can shift the FLCD 167 to the second position. The FLCD 167 can be or include a ball-valve, a flapper valve, and/or a formation isolation valve ("FIV").

The operation of the completion assembly 100 is depicted in FIGS. 1-5. When the completion assembly 100 is conveyed into the wellbore, the flow control valve 140 can be in the closed position, the straddle seal 166 can be coupled to the latch mechanism 186, and the sleeve 165 can be in the open position allowing fluid communication via the treatment ports 182, 183, as shown in FIG. 1. The service tool 125 and the tubular member 120 can be connected or coupled together at the surface of the wellbore 101. After the service tool 125 and the tubular member 120 are connected together, the drill pipe 137 connected to the setting tool 131 of the service tool 125 can be used to convey the completion assembly 100 into the wellbore 101. In at least one embodiment, the straddle seal 166 is conveyed into the wellbore 101 with the completion assembly 100 in a single trip. For example, in conveying the completion assembly 100 into the wellbore, the straddle seal 166 can be coupled thereto and conveyed with the completion assembly. Accordingly, the straddle seal 166 can be conveyed into the wellbore 101 with the completion assembly 100 to provide a fluid pressure barrier in a single trip and/or without a second trip.

When the completion assembly 100 is conveyed to the desired location within the wellbore 101 the ball 195 can be deployed into the bore 148 of the inner tubular 134 until the ball 195 engages or catches the ball seat 150 of the flow control valve 140, thereby providing a fluid tight seal therewith. When the ball 195 is engaged with the ball seat 150 of the flow control device, pressure can build within the completion assembly 100 to set the packers 171, 175. Once the packers 171, 175 are set, the setting tool 131 can be rotated to actuate the collets 111, 112, thereby releasing the setting tool 131 from the second tubular 120. The rotation of the setting tool 131 can be applied through the drill pipe 137. As previously discussed, the setting tool 131 can also be released from the second tubular 120 via hydraulic pressure by building pressure within the completion assembly 100. The first packer 175 can keep the tubular member 120 in a static position by applying an equal and opposite counter force to the rotation force applied to the setting tool 131. As previously discussed, after the setting tool 131 is released from the tubular member 120, the service tool 125 can be repositioned along the wellbore 101. Releasing the setting tool 131 from the tubular member 120 can provide fluid communication via the ports 138, 139 disposed about the service tool 125 adjacent the setting tool 131, thereby providing fluid communication between the inner annulus 135 and the first portion 108 of the wellbore 101.

Once the packers 171, 175 are set in the wellbore 101 and the service tool 125 is released and repositioned, a downhole operation (e.g. gravel pack) can be performed. FIG. 2 depicts a cross-sectional view of the completion assembly 100 with the tubular member 120 and the service tool 125 positioned to perform a gravel pack operation, according to one or more embodiments. After locating the service tool 125 pressure can build within the inner tubular 134. The pressure within the inner tubular 134 can be communicated to the sliding body 154 to actuate the flow control valve 140, thereby allowing fluid communication from the bore 148 of the inner tubular 134 to the second annulus 104 via the orifice 146 and the cross-over port 151.

Upon actuating the flow control valve 140, a gravel slurry 210 can be pumped into the first annulus 103 via the bore 148 of the inner tubular 134, the cross-over port 151, and the treatment ports 182, 183. The gravel slurry 210 can pack about the outer surface of the tubular member 120 along the first annulus 103. As previously discussed, the gravel slurry 210 can contain particulate and a carrier fluid 220. The carrier fluid 220 in the gravel slurry 210 can flow into the tubular member 120 via the screen assembly 174, which dehydrates the gravel slurry 210 and deposits the particulates within the first annulus 103. After the carrier fluid 220 flows into the tubular member 120, the carrier fluid 220 can flow to the surface of the wellbore 101 via the wash pipe 135 of the service tool 125, the one-way valve 168, the inner annulus 135, the ports 138, 139, and the first portion 108 of the wellbore 101. After pumping the gravel slurry 210 into the first annulus 103, the setting tool 131 can be repositioned to actuate the sleeve 165 to close the treatment ports 182, 183 of the housing 172. For example, the setting tool 131 can be moved via the drill pipe 137 such that the sleeve collet 161 engages and actuates the sleeve 165 to a closed position, thereby preventing fluid communication via the treatment ports 182, 183.

FIG. 3 depicts a cross-sectional view of the completion assembly 100 with the service tool 125 positioned to perform a reverse flow operation, according to one or more embodiments. After actuating the sleeve 165 to close the treatment ports 182, 183, a completion fluid 310 can be pumped into the first portion 108 of the wellbore 101. The completion fluid 310 can be circulated from the first portion 108 of the wellbore 101 back to the surface via the cross-over port 151, the inner tubular 134, the setting tool 131, and the drill pipe 137. The circulation of the completion fluid 310 can remove and/or clean any remaining fraction of the gravel slurry 210, the carrier fluid 220, and/or the particulate present. An illustrative completion fluids 310 can include, but is no limited to a brine including one or more viscoelastic polymers. The viscoelastic polymers of the brine can provide a completion fluid with increased viscosity. After the reverse flow operation, the service tool 125 can be moved in an upward direction such that the straddle seal collet 162 can disengage the latch mechanism 186 coupling the straddle seal 166 to the tubular member 120.

Figure 4:
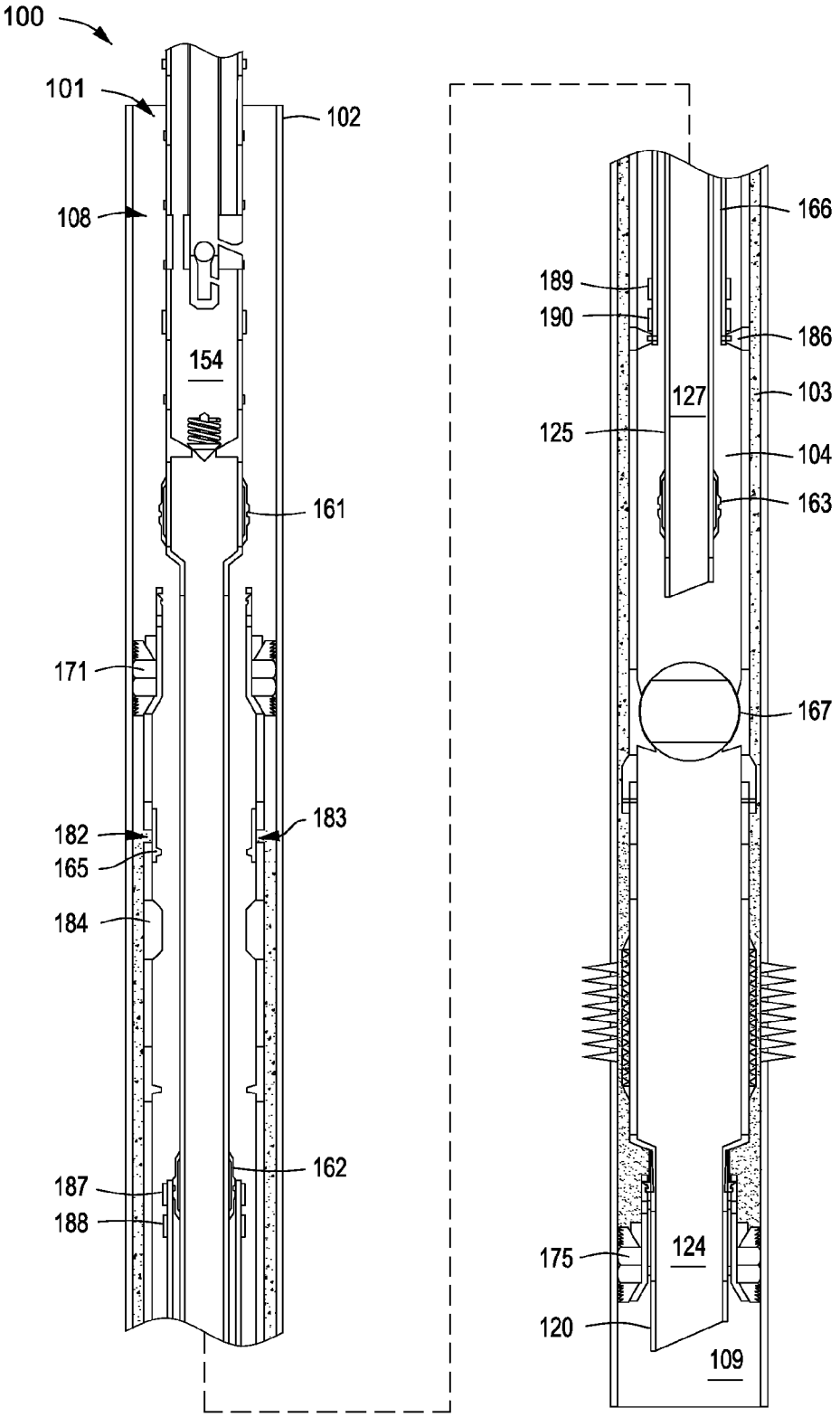
FIG. 4 depicts a cross-sectional view of the completion assembly with the service tool positioned to disengage the straddle seal, according to one or more embodiments disclosed.

FIG. 4 depicts a cross-sectional view of the completion assembly 100 with the service tool 125 positioned to disengage the straddle seal 166, according to one or more embodiments. When the service tool 125 is removed, the FLCD collet 163 can also shift the FLCD 167 to the second position, thereby preventing fluid communication through the bore 124 of the tubular member 120.

FIG. 5 depicts a cross-sectional view of the completion assembly 100 with the service tool 125 removed from the wellbore 101, according to one or more embodiments. As previously discussed, the movement of the service tool 125 in the upward direction can move the straddle seal 166 into the second or "closed" position, as shown in FIG. 5.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via another element or member." The terms "hot" and "cold" refer to relative temperatures to one another.

Although only a few example embodiments have been described in detail above, those skilled in the art will readily appreciate that many modifications are possible in the example embodiments without materially departing from "Methods and Systems for Treating a Wellbore." Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw can not be structural equivalents in that a nail employs a cylindrical surface to secure wooden parts together, whereas a screw employs a helical surface, in the environment of fastening wooden parts, a nail and a screw can be equivalent structures. It is the express intention of the applicant not to invoke 35 U.S.C. §112, paragraph 6 for any limitations of any of the claims herein, except for those in which the claim expressly uses the words 'means for' together with an associated function.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

What is claimed is:

1. A completion assembly for treating a wellbore, comprising:

a tubular member having a bore formed axially therethrough and a port formed radially therethrough, wherein the tubular member is adapted to be run into a wellbore such that an annulus is disposed radially outward from the tubular member, and wherein the port is adapted to provide fluid communication between the annulus and the bore;

a packer coupled to the tubular member and extending radially-outward therefrom, wherein the packer is adapted to isolate first and second portions of the annulus;

a seal bore coupled to the tubular member and extending radially-inward therefrom, wherein the port is disposed axially between the packer and the seal bore;

a straddle seal adapted to be run into the wellbore with the tubular member in a single trip, wherein the straddle seal is run into the wellbore in a first position where the straddle seal is positioned below the packer, the seal bore, or both; and a service tool run into the wellbore with the tubular member, wherein the service tool is configured to release the straddle seal from a locking mechanism on the tubular member and to move the straddle seal from the first position to a second position where the straddle seal is adapted to form seals that are axially-aligned with the packer and the seal bore to prevent fluid flow through the port.

2. The completion assembly of claim 1, wherein the straddle seal contacts the packer and the seal bore when in the second position.

3. The completion assembly of claim 1, further comprising a sleeve coupled to the tubular member and adapted to seal the port to prevent fluid flow between the annulus and the bore.

4. The completion assembly of claim 3, wherein the service tool is detachably coupled to the tubular member and disposed therein forming a second annulus therebetween.

5. The completion assembly of claim 1, further comprising a sleeve collet coupled to the service tool, wherein the sleeve collet is adapted to move the sleeve to seal the port.

6. The completion assembly of claim 1, further comprising a straddle seal collet coupled to the service tool, wherein the straddle seal collet is adapted to release the straddle seal from the locking mechanism.

7. The completion assembly of claim 1, wherein the straddle seal provides a fluid pressure barrier between the annulus and the bore with a fluid seal rating from about 5,000 psi to about 15,000 psi.

8. The completion assembly of claim 2, wherein the port is adapted to have a portion of a gravel slurry flow therethrough when the straddle seal is in the first position.

9. The completion assembly of claim 2, further comprising a screen assembly coupled to the tubular member, wherein the screen assembly and the port are adapted to have a portion of a gravel slurry flow therethrough when the straddle seal is in the first position.

10. The completion assembly of claim 5, wherein the sleeve is adapted to be actuated from a first position to a second position using the service tool when the sleeve collet is engaged with the sleeve and the service tool moves with respect to the tubular member, wherein the sleeve is axially offset from the port when in the first position, and wherein the sleeve is substantially axially aligned with the port and prevents fluid flow through the port when in the second position.

11. A method for treating a wellbore, comprising:

locating a completion assembly within the wellbore, wherein the completion assembly comprises:

a tubular member having a bore formed axially therethrough and a port formed radially therethrough, wherein an annulus is disposed radially outward from the tubular member, and wherein the port provides fluid communication between the annulus and the bore;

a packer coupled to the tubular member and adapted to isolate first and second portions of the annulus;

a seal bore coupled to the tubular member such that the port is disposed axially between the packer and the seal bore; and a straddle seal adapted to be run into the wellbore with the completion assembly in a single trip;

actuating a sleeve from a first position to a second position with a service tool, wherein the sleeve is axially offset from the port when in the first position, and wherein the sleeve is substantially axially aligned with the port and prevents fluid flow through the port when in the second position; and actuating the straddle seal from a first position and a second position with the service tool, wherein the straddle seal is axially offset from the port when in the first position, and wherein the straddle seal forms seals that are substantially axially aligned with the packer and the seal bore such that the straddle seal prevents fluid flow through the port when in the second position.

12. The method of claim 11, further comprising:

releasing the straddle seal from a locking mechanism with a straddle seal collet coupled to the service tool, wherein the locking mechanism couples the straddle seal to the tubular member in the first position.

13. The method of claim 11, wherein the straddle seal provides a fluid pressure barrier between the annulus and the bore with a fluid seal rating from about 5,000 psi to about 15,000 psi when in the second position.

14. The method of claim 11, wherein the straddle seal comprises one or more seal members coupled thereto, and wherein the seal members are adapted to contact the packer and the seal bore in the second position to provide a fluid pressure barrier.

15. A method for treating a wellbore, comprising:

locating a completion assembly within the wellbore, wherein the completion assembly comprises:

a tubular member having a bore formed axially therethrough and a port formed radially therethrough, wherein an annulus is disposed radially outward from the tubular member, and wherein the port provides fluid communication between the annulus and the bore;

a packer coupled to the tubular member and adapted to isolate first and second portions of the annulus;

a seal bore coupled to the tubular member such that the port is disposed axially between the packer and the seal bore;

a straddle seal adapted to be run into the wellbore with the completion assembly in a single trip; and a screen assembly coupled to the tubular member and disposed below the port, wherein at least a portion of a gravel slurry is adapted to flow from the annulus, through the screen assembly, and into the bore; and actuating the straddle seal between a first position and a second position with a service tool, wherein the straddle seal is axially offset from the packer, the seal bore, or both when in the first position, and wherein the straddle seal forms seals that are substantially axially aligned with the packer and the seal bore such that the straddle seal prevents fluid flow through the port when in the second position.

16. The method of claim 15, further comprising:

flowing the gravel slurry into the annulus through the port;

depositing particulates of the gravel slurry within the annulus; and flowing a carrier fluid of the gravel slurry through the screen assembly and into the bore of the tubular member.

17. The method of claim 15, wherein the straddle seal is coupled to the tubular member via a locking mechanism, and wherein the service tool further comprises a straddle seal collet adapted to release the straddle seal from the locking mechanism and actuate the straddle seal between the first and second positions.

18. The method of claim 16, wherein the straddle seal provides a fluid pressure barrier between the annulus and the bore with a fluid seal rating from about 5,000 psi to about 15,000 psi when in the second position.

19. The method of claim 15, further comprising actuating a sleeve from a first position to a second position with a service tool, wherein the sleeve is positioned below the port when in the first position, and wherein the sleeve contacts the tubular member such that the sleeve prevents fluid flow between the annulus and the bore when in the second position.

20. The method of claim 16, wherein the straddle seal comprises one or more seal members coupled thereto, wherein the seal members are adapted to contact the packer and the seal bore in the second position to provide a fluid pressure barrier.

* * * * *